United States Patent [19]

Wong

[11] Patent Number: 4,999,990

[45] Date of Patent: Mar. 19, 1991

[54] EXPANSION LINKAGE FOR FASHION WATCH BAND

[75] Inventor: Roger Y. L. Wong, Hong Kong, Hong Kong

[73] Assignee: Timex Corporation, Middlebury, Conn.

[21] Appl. No.: 525,003

[22] Filed: May 18, 1990

[51] Int. Cl.[5] ..... A44C 5/08

[52] U.S. Cl. ..... 59/79.1; 59/79.3; 63/5.1

[58] Field of Search ..... 59/79.1, 79.3, 80; 63/5.1

[56] References Cited

U.S. PATENT DOCUMENTS

| | | | |
|---|---|---|---|
| 3,596,464 | 8/1971 | Bert | 59/79.1 |
| 3,786,629 | 1/1974 | Rieth | 59/79.1 |
| 4,300,346 | 11/1981 | Kugler | 59/79.1 |
| 4,723,406 | 2/1988 | Ripley | 59/79.1 |

*Primary Examiner*—David Jones
*Attorney, Agent, or Firm*—William C. Crutcher

[57] ABSTRACT

An expansion bank linkage of the type having an outer row of outer links and an inner row of staggered inner links, clips conencting each of the links of one row with two links of the other row and a spring in each of the links for resisting displacement when the linkage is stretched longitudinally. The improvement comprises a plurality of first and second clips having flat inner and outer legs connected by a central portion arranged to skew the legs with respect to one another. The first clips are skewed in an opposite sense than the second clips, the clips being arranged so that a first clip leg and a second clip leg are disposed adjacent one another in each of the links whereby the inner and outer links are held in laterally spaced relationship along the length of the linkage when it is in a relaxed position.

4 Claims, 3 Drawing Sheets

EXPANSION LINKAGE FOR FASHION WATCH BAND

BACKGROUND OF THE INVENTION

This invention relates generally to an expansion linkage suitable for making fashion watchbands, bracelets and the like. More particularly, the invention relates to an improved expansion linkage permitting nested decorative shells attached to the top links of an expansion linkage.

Expansion linkages are known of a general type represented by U.S. Pat. No. 3,587,226 - issued June 28, 1971 to Rieth, wherein outer and inner rows of links are attached by U-shaped clips, the legs of the clips being resiliently biased against the walls of the generally rectangular links. This construction permits expansion of the linkage in a direction generally along the length of the linkage and contraction by the resiliently biased clips when tension on the linkage is relaxed. In order to decorate the outer row, shells of different metals, patterns and shapes are attached to the outer links.

Greater flexibility in design is possible if the shells can be manufactured so as to provide nested or offset sections along the length of the linkage. This permits construction of fashion watchbands and the like which disguise the underlying expansion linkage construction. However, the nested sections of the shells require extra space between expansion links.

Various means have been employed to provide the added spacing between links along the length of the linkage. For example, U.S. Pat. No. 4,723,406 - issued Feb. 9, 1988 to Ripley discloses a construction in which the inner links are wider than the outer links so as to hold the outer links spaced apart from one another. This adds lateral spacing to provide for nesting of decorative top shells attached to the outer links. This construction requires links of two different widths.

It would be desirable to provide a standard expansion linkage which automatically provides spacing between links to allow for more flexibility in creating decorative top shells permitting simulation of link bracelets or interwoven designs of the links. It would also be desirable to provide an expansion linkage wherein outer and inner links have the same width.

Accordingly, one object of the present invention it to provide an improved expansion linkage suitable for fashion watchbands and the like which provides spacing for nested top shells.

Another object of the invention is to provide an improved expansion linkage using links of the same width for inner and outer rows.

SUMMARY OF THE INVENTION

An expansion band linkage of the type having an outer row of outer links and an inner row of staggered inner links, clips connecting each of the links of one row with two links of the other row and a spring in each of the links for resisting displacement when the linkage is stretched longitudinally. The improvement comprises a plurality of first and second clips having flat inner and outer legs connected by a central portion arranged to skew the legs with respect to one another. The first clips are skewed in an opposite sense than the second clips, the clips being arranged so that a first clip leg and a second clip leg are disposed adjacent one another in each of the links whereby the inner and outer links are held in laterally spaced relationship along the length of the linkage when it is in a relaxed position.

DRAWING

Other objects and advantages of the invention will be better understood by reference to the following description, taken in connection with the accompanying drawing, in which:

FIG. 1 is a side elevational view, partly in cross-section, of a portion of an improved fashion watch band in a relaxed position, having a first type decorative top shell, FIG. 2 is a side elevational view of the watch band of FIG. 1 in an expanded position, FIG. 3 is a top plan view of the watch band, partly in cross-section, taken along lines III—III of FIG. 1, FIG. 4 is a top plan view of the watchband, partly in cross-section, taken along lines IV—IV of FIG. 2, FIG. 5 is an enlarged end elevational view in cross section, taken along lines V—V of FIG. 1, FIG. 6 is an enlarged end elevational view in cross section, taken along lines VI—VI in FIG. 2, FIG. 7 is a cross-sectional side elevation view of the expansion linkage in a relaxed position, before top shells have been attached, FIG. 8 is an enlarged perspective view of a skewed clip used in the present invention, FIG. 9 is an enlarged end view of two clips, each skewed in an opposite sense from the other in accordance with the present invention, and illustrating the skew angle, FIG. 10 is a perspective view looking at the bottom side of an outer link, during assembly, with a decorative shell partially attached, FIGS. 11–15 illustrate the invention with another type of decorative top shell and correspond to description of the previous FIGURES as follows:

FIG. 11 corresponds to FIG. 1,
FIG. 12 corresponds to FIG. 2,
FIG. 13 corresponds to FIG. 3,
FIG. 14 corresponds to FIG. 4, and
FIG. 15 corresponds to FIG. 10.

DESCRIPTION OF THE PREFERRED EMBODIMENT

Figure 7:
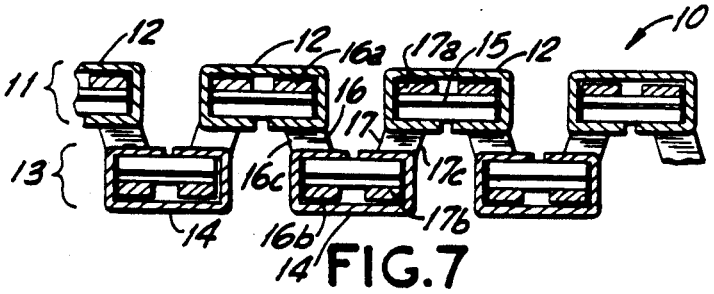

Referring first to FIG. 7 of the drawing, a cross section is shown through the longitudinal center of the linkage before the top shells have been added. A portion of an expansion linkage 10 is shown in its relaxed state. An outer row 11 of outer links 12 overlies an inner row 13 of inner links 14. Each of the inner and outer links 12, 14 is hollow, preferably of the same rectangular cross section and extends generally transverse to the length of the linkage. Outer links 12 are staggered with respect to inner links 14 along the length of the linkage.

Each of the links 12, 14 includes a resilient spring means such as a leaf spring 15 disposed in the link and extending along its length. The links are connected by C-shaped links 16 and 17, such that each of the links of one row is connected with two links of the other row. Links 16, 17 have flat outer legs 16*a*, 17*a*, respectively, and have flat inner legs 16*b*, 17*b*, respectively connected by central portions 16*c*, 17*c*, respectively. The outer legs of clips 16, 17 are skewed in an opposite sense with respect to one another, relative to their respective inner legs.

The remainder of the clips along the length of the linkage are identical either to clip 16 or to clip 17. There are clips arranged in the same manner at both ends of each link. The legs 16*b*, 17*b* of clips of 16 and 17 are disposed adjacent one another in the link 14 and are biased flat against the wall of the link by the leaf spring 15. Therefore, the outer legs 16*a*, 17*a* are separated and are similarly biased by their springs against the inside walls of the two outer links 12. In this way, the skewed clips serve to space two outer links laterally from one another. In like manner, each of the links has two legs of the two different types of clips 16, 17 disposed adjacent one another in the end of the link which serves to hold all of the links spaced from one another along the length of the linkage.

Figure 1:
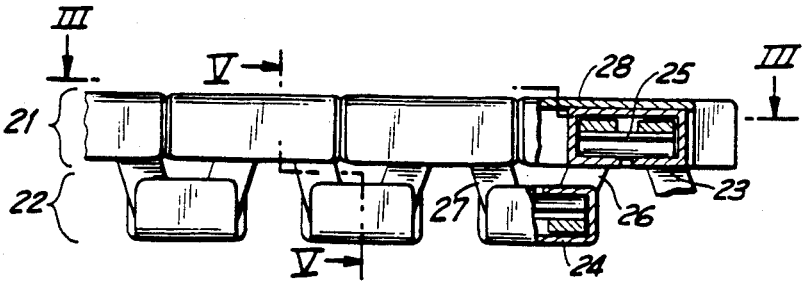
Figure 2:
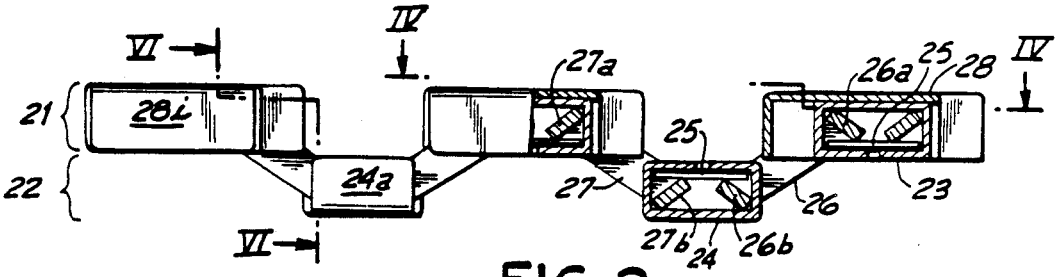
Figure 3:
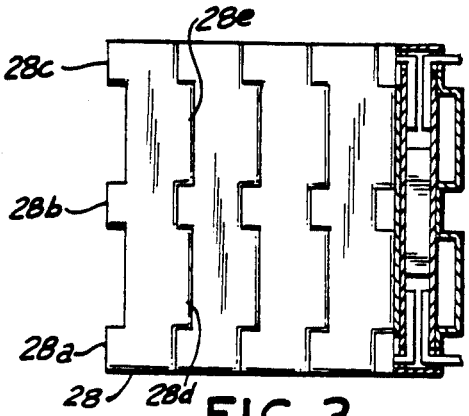
Figure 4:
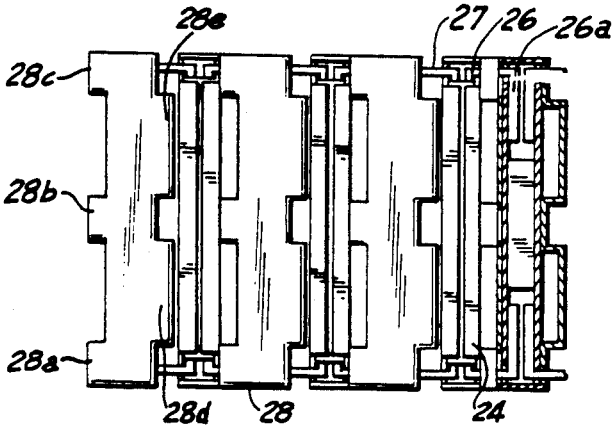
Figure 5:
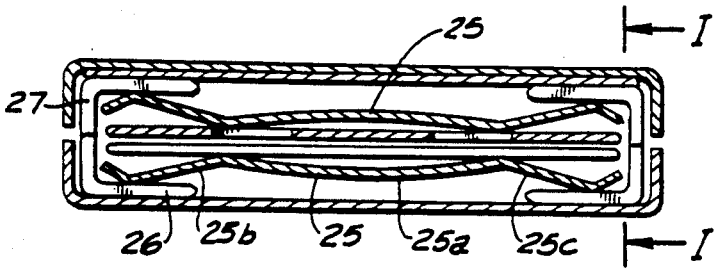

Referring now to FIGS. 1 through 6 of the drawing, a section of a fashion watch band is shown comprising expansion linkage with the top shell added to the top links of FIG. 7. FIG. 1 shows an outer row 21 and an inner row 22 of an expansion linkage with decorative top shells in a relaxed position, while FIG. 2 shows the same linkage in an expanded position. The cross section part of FIG. 1, which is taken along lines I—I in FIG. 5, shows outer links 23, inner links 24, each having a resilient spring means 25 disposed therein. Links 23, 24 are held spaced from one another by skewed clips 26, 27 in the manner previously described in connection with FIG. 7. When the band is expanded in FIG. 2, legs 26*a*, 26*b*, 27*a*, 27*b*, tilt to displace the ends of the leaf springs 25. This creates spring biasingforces tending to return the expansion linkage from an expanded to a relaxed state.

The top links 23 have decorative top shells 28 attached thereto. Each of the top shells has an end tab 28*i* piece 28*a* which hides the mechanism inside. The inner links have a similar tab 24*a* which hides the mechanism inside and retains the clips in place.

Referring to FIGS. 3 and 4, it is seen that each top shell 28 defines lateral protrusions 28*a*, 28*b*, 28*c* on one side and lateral protrusions 28*d*, 28*e* on the other side. The protrusions on one side are designed to nest within the spaces between the conjugate protrusions on the adjacent top shell. Since the linkage holds the top links 23 spaced apart from one another, there is no difficulty in designing top shells having nesting or alternating protrusions of any desired configuration.

Figure 6:
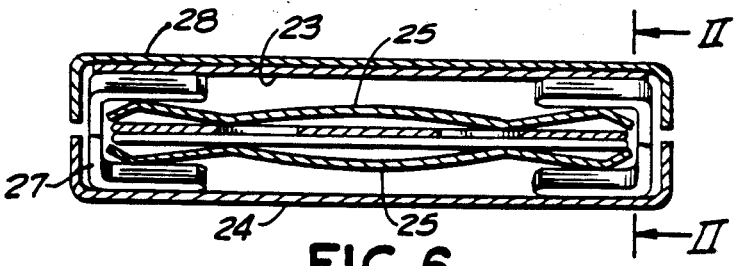

FIGS. 5 and 6 further depict cross sections through the relaxed and expanded linkages, respectively, of FIGS. 1 and 2. FIGS. 5 and 6 illustrate the shape of the resilient springs 25. These have a central leaf spring section 25*a* and are bent so that opposite ends 25*b*, 25*c* bias the legs of the clips against the walls of the links.

Figure 8:
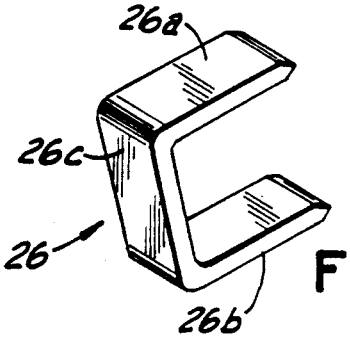

FIG. 8 is a perspective view showing that each of the clips 26 has flat legs 26*a*, 26*b*, joined by a central portion 26*c* which serves to hold the two flat legs parallel and to skew one with respect to the other, so that the legs lie in two spaced parallel planes, but are laterally displaced from one another.

Figure 9:
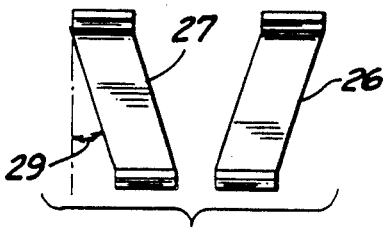

In FIG. 9, an end view of a clip 26 is shown alongside a clip 27. The legs of the clips are skewed in an opposite sense so as to offset the outer legs with respect to the inner legs. A preferred skew angle shown by reference numeral 29 is about 20 degrees but will vary with the application to lie between a range of 10° and 40° .

Figure 10:
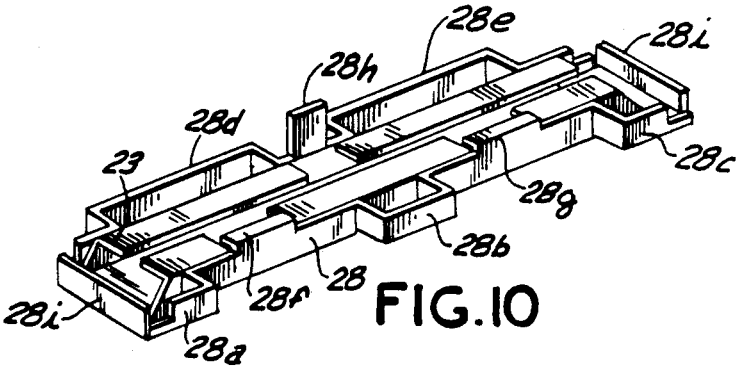

Referring to FIG. 10, a top shell 28 is shown in process of assembly to an outer link 23. The protrusions 28*a* through 28*e* are formed by box-like sections. Between the box-like sections, tabs 28*f*, 28*g*, 28*h* are provided for bending down into cut-out spaces provided in the bottom wall of outer link 23. Tab 28*a* is shown before it has been bent into place. End tabs 28*i* are folded up to complete the assembly and hold the clips in place.

Figure 11:
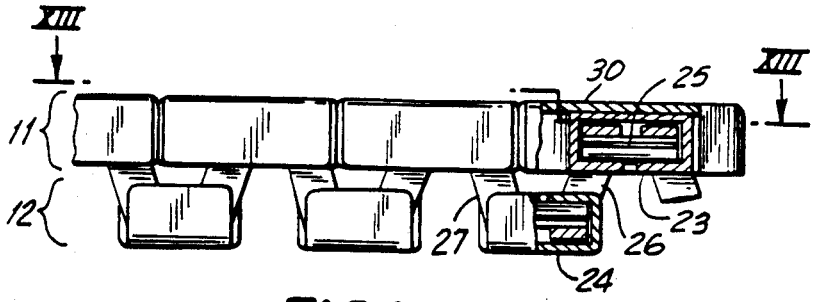
Figure 12:
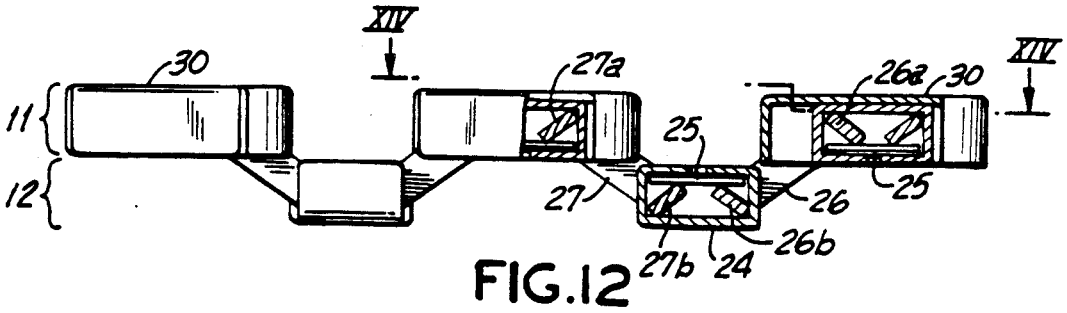
Figure 13:
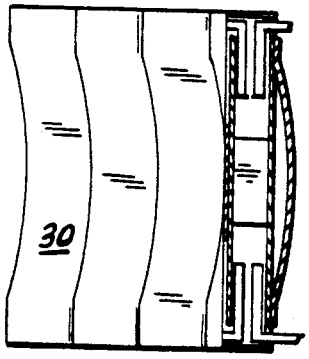
Figure 14:
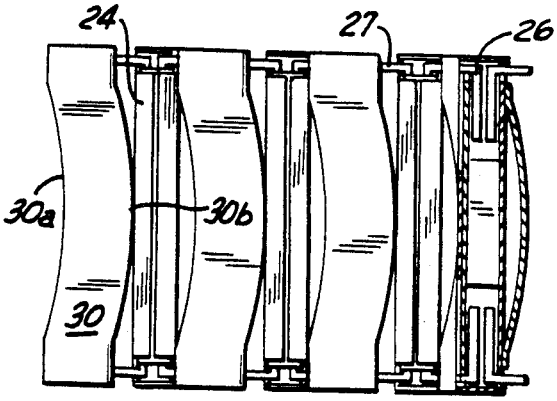

Reference to FIGS. 11–15 of the drawing shows another decorative top shell. FIGS. 11 and 12 use the same expansion linkage of FIG. 7 as before, the reference numerals being the same except as follows. In place of the decorative shell 28 of the previous FIGS. described, a decorative top shell 30 is attached to each of the top links 23. As best seen the the plan views of FIGS. 13, 14, each of the top links 30 has a concave portion 30*a* on one side and a convex portion 30*b* on the other side. 30*a* and 30*b* nest with one another as seen in FIG. 13 when the linkage is in a relaxed position.

Figure 15:
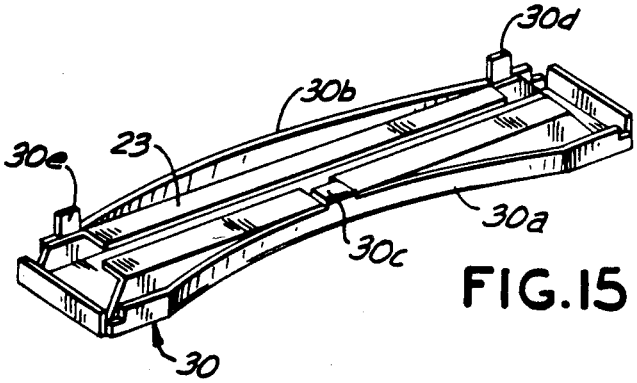

Referring to FIG. 15, the bottom view of the top link with shell attached shows how the shell is constructed. Top length 23 is encased by shell 30. The concave section 30*a* of the shell includes a fastening tab 30*c* at the point where it is closest to link 23. The convex portion 30*b* includes two tabs 30*d*, 30*e* which are shown before they have been bent into suitable cut-out sections in the bottom wall of link 23 as before.

The above described invention provides a simple means for supplying an expansion linkage to which various types of decorative shells may be attached which have nesting or mating sections in order to enhance the appearance. The nesting sections are accommodated by means of the lateral spacing between the top links provided by the skewed clips. It is unnecessary to maintain an inventory of two different widths for the upper and lower links.

The expansion linkage is suitable for varying sizes of links and varying spacings, as well as any reasonable number, shape, and spacing of protrusions.

While there has been described what is considered to be the preferred embodiment of the invention, other modifications will occur to those skilled in the art, and it is desired to include in the appended claims all such modifications as fall within the true spirit and scope of the invention.

I claim:

1. Improvement in an expansion linkage of the type having an outer row of other links and an inner row of inner links, each of said links having a wall portion extending generally transverse to the length of said linkage, said outer row overlying said inner row with an outer link wall portion parallel to an inner link wall portion, said outer links being staggered along the length of linkage with respect to said inner links, clip means connecting each of the links of one row with two links of the other row to provide displacement of the links relative to one another along the linkage when the linkage is stretched longitudinally from a relaxed to an expanded position, and resilient spring means disposed in each of said links for resisting said displacement, wherein said improvement comprises:

the clip means comprising a plurality of first and second clips, each said clip having two parallel flat legs spaced from one another and connected by a central portion arranged to skew said legs with respect to one another, said first clips being skewed in an opposite sense than said second clips, said clips being arranged so that a leg of a first clip and a leg of a second clip are disposed side-by-side adjacent one another in each of said links and held coplanar with one another and against said link wall portion by said resilient spring means when the linkage is in a relaxed position, whereby the inner and outer links are held by said clip means in spaced relationship from one another along the length of the linkage when it is in a relaxed position, so as to define lateral spaces at least between said outer links.

2. The improvement according to claim 1, and further including a shell having lateral sides and attached to each of said top links, said shell having at least one protrusion on one lateral side thereof extending into one of said lateral spaces and defining corresponding protrusion-receiving sections on the opposite lateral side thereof, said protrusions and said protrusion-receiving sections adapted to nest when the expansion linkage is in a relaxed position.

3. The improvement according to claim 2, wherein there is at least one protrusion on one lateral side of a top shell, and at least two protrusions on the opposite lateral side of said top shell, said protrusion-receiving section being defined between said last mentioned two protrusions.

4. The improvement according to claim 2, wherein said protrusion on one lateral side of a top shell is a convex arcuate section and where said protrusion-receiving section on the other lateral side is a concave arcuate section.

* * * * *